United States Patent [19]

Buckner

[11] 4,287,138

[45] Sep. 1, 1981

[54] DIRECT CONTACT GASEOUS TO LIQUID HEAT EXCHANGE AND RECOVERY SYSTEM

[76] Inventor: Lynn A. Buckner, P.O. Box 3326, Burlington, N.C. 27215

[21] Appl. No.: 127,502

[22] Filed: Mar. 5, 1980

Related U.S. Application Data

[62] Division of Ser. No. 9,172, Feb. 2, 1979.

[51] Int. Cl.[3] ..... B01F 3/04

[52] U.S. Cl. ..... 261/128; 8/149.1; 8/149.3; 34/37; 55/89; 261/115; 261/116; 261/118; 261/151; 261/DIG. 27

[58] Field of Search ..... 261/36 R, 110, 151, 261/128, DIG. 9, DIG. 27, DIG. 10, 115–118; 55/84, 85, 89, 94; 8/149.1, 149.2, 149.3; 68/1, 5 R, 38, 92, 183, 207; 34/37; 162/48, 272, 63, 68

[56] References Cited

U.S. PATENT DOCUMENTS

| | | | |
|---|---|---|---|
| 2,826,397 | 3/1958 | Lofgren et al. | 261/151 X |
| 3,104,936 | 9/1963 | Fuhring | 55/85 X |
| 3,239,999 | 3/1966 | Price | 261/DIG. 27 |
| 3,396,514 | 8/1968 | Hurst et al. | 55/85 X |
| 3,494,099 | 2/1970 | Eng et al. | 261/115 X |
| 3,762,394 | 10/1973 | Newcomer | 261/115 X |
| 3,800,505 | 4/1974 | Tarves, Jr. | 261/151 X |
| 4,044,078 | 8/1977 | Curtis et al. | 261/151 X |
| 4,062,912 | 12/1977 | Sonnenschein et al. | 261/DIG. 10 |

*Primary Examiner*—Richard L. Chiesa

*Attorney, Agent, or Firm*—Lane, Aitken, Ziems, Kice & Kananen

[57] ABSTRACT

A method is disclosed for recovering and reclaiming heat from a source of relatively hot gases, which are preferably substantially vapor-saturated, by directly contacting the gases with a relatively cooler spray of liquid, such as water, in a heat exchange zone. The relatively warm liquid resulting from the contact of the sprayed cooler liquid with the vapor-saturated gases are collected in a receiver zone in the heat exchanger. This relatively warm liquid is then available for use. The hot gases which entered the heat exchanger will exit at a cooler temperature. They may be released to the atmosphere or returned to a process or room. The method is particularly suited for recovering heat from steam system condensate vents, dye fixation steamer exhausts, boiler exhaust stacks, and dry can enclosures such as those used in the textile and paper industry.

8 Claims, 4 Drawing Figures

DIRECT CONTACT GASEOUS TO LIQUID HEAT EXCHANGE AND RECOVERY SYSTEM

This is a division of application Ser. No. 009,172, filed Feb. 2, 1979.

BACKGROUND OF THE INVENTION

This invention relates to a direct contact heat exchange method for recovering heat from hot gases and particularly from substantially vapor-saturated hot gases. More particularly, this invention relates to directly contacting a hot gas with a relatively cooler spray of liquid to transfer heat from the gas into the liquid and collecting the heated liquid in a receiver. From the receiver, the liquid is transported to a point of use. Still more particularly, this invention relates to a direct contact heat exchange method for recovering heat from the exhaust gases from steam system condensate vents, dye fixation steamer exhausts, boiler exhaust stacks and dry can enclosures.

In the prior art it has been known that significant amounts of energy are released to the atmosphere from steam system condensate vents, dye fixation steamer exhausts and dry can enclosures, but it has not been economically feasible to reclaim this energy with known technology. The relatively pure steam discharged from the condensate vents and steamer exhausts are at very low pressures and are not, therefore, useful for direct process use. These sources of energy could be reclaimed with shell and tube exchangers. However, their relatively high cost, high fouling rate, low reclaim efficiency and larger size do not make them feasible. The contact heat exchanger described in this application provides the mechanism for economically reclaiming this energy.

Previously, it has not been known that dry cans would remain efficient if totally enclosed. Partial enclosures have been applied to dry cans as heat shields in order to protect operators working in the area from radiant heat. In other cases, dry cans have been enclosed sufficiently enough to reduce convection heat losses to the room thus improving to a degree the working area around the cans and reducing the energy consumption by a proportionate amount.

It is the aim of this invention to utilize a system which provides a method of totally enclosing the dry can unit, transport the heated gases from the enclosure to a contact heat exchanger (also described as part of the invention), collect the cooled gases which leave the contact heat exchanger and transport them back to the dry can enclosure, thus making a closed loop. Also described is a method of transferring the energy to a liquid, preferably process water, in order to produce hot water.

Advantages of this system are: reduced radiation and convection of heat from the dry cans to the surrounding room, minimized escape of moisture to the room, reduced demand for room make-up air, reduced steam required per pound of liquid dried, reduced air handling within the system thus less fan HP and, most important, the reclaim and reuse of energy which would otherwise be discharged into the atmosphere.

Previously, boiler stacks have been equipped with economizer tubes in order to reclaim energy being discharged to the atmosphere. However, these units are not capable of reducing the stack gases below approximately 400° F. The stacks may also be equipped with electrostatic precipitators or scrubbers in order to remove pollutants.

It is the intent of this patent to describe a process and contact heat exchanger mechanism which can be used singularly or in combination with an economizer or scrubber in order to reclaim heat from the boiler stack.

These and other objects of the invention will become apparent from the accompanying drawings and the written description of the invention.

BRIEF SUMMARY OF THE INVENTION

Direct to achieving the aforestated objects, the method includes the step of providing a source of substantially vapor-saturated gas at a first elevated temperature wherein the improvement according to the invention comprises the procedural combination of steps of containing the vapor-saturated gas and directing the gas to an upstanding heat exchanger having a means for receiving the contained gas. The vapor-saturated gases may be obtained from condensate vents, steamer exhausts, or dry can enclosures in the textile industry. When the later are used, means are provided in the form of a hood for substantially enveloping the dry cans to direct heat from the dry cans to the heat exchanger. Within the heat exchanger, the vapor-saturated gas is directly contacted with a relatively cooler spray of liquid provided from a liquid circulation network having a relatively cool source of liquid for the spray heads. The contacting step occurs as a result of a plurality of spray heads located along a substantial length of the heat exchanger for dispersing significant amounts of the relatively cooler liquid substantially throughout a direct contact heat exchange zone in the heat exchanger. The dispersing step provides a plurality of liquid phase droplets from the plurality of spray heads in the heat exchanger to form a repetitive plurality of liquid phase barriers for intimate contact with the substantially saturated vapor within the heat exchange zone.

The relatively warm liquid, resulting both from the agglomeration of sprayed relatively cool liquid and condensation of at least a portion of the saturated vapor in the heat exchanger, is collected in a receiver zone. From there it is transported to a point of use, while exhausting the gas which is relatively cool compared to the substantially saturated inlet gas.

DETAILED DESCRIPTION OF THE PREFERRED EMBODIMENT

Figure 1:
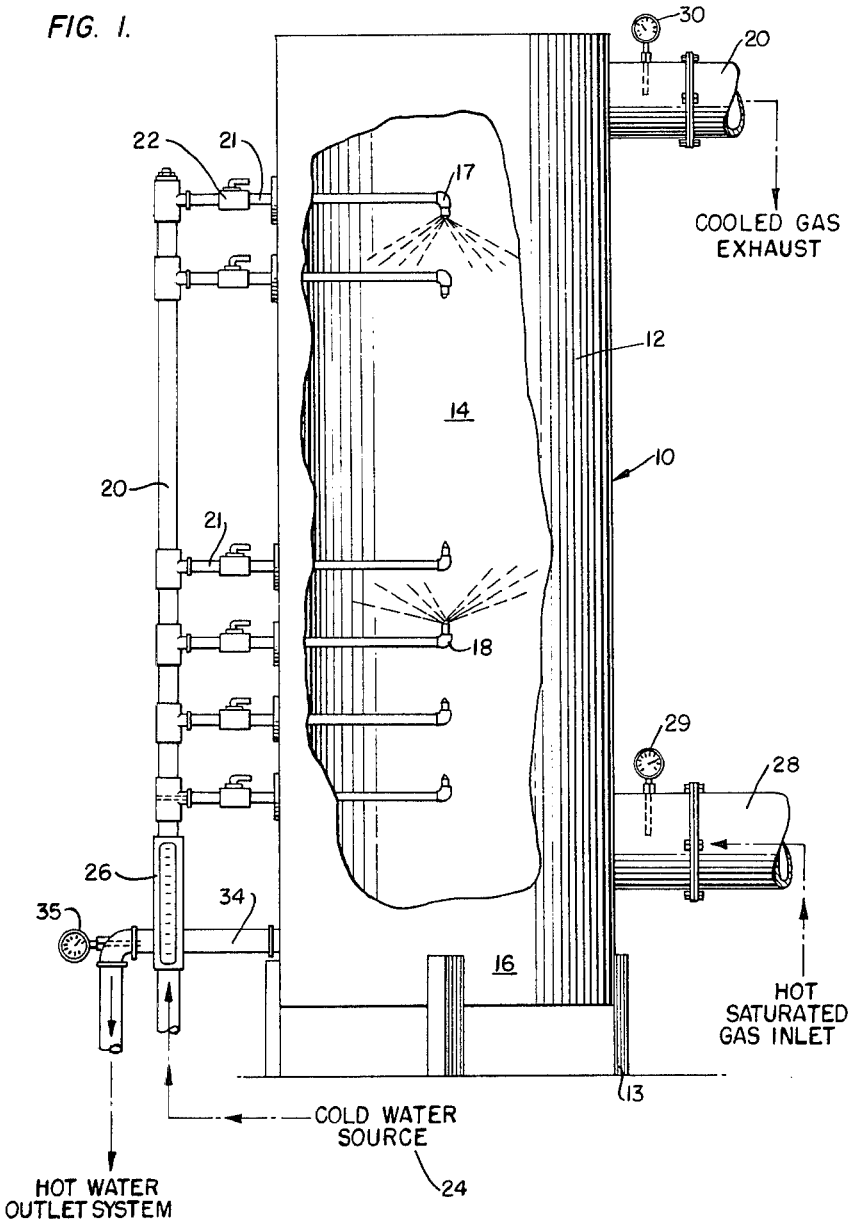
FIG. 1 is a partially cut-away side elevational view of the direct contact heat exchanger for use in the method and combination according to the invention.

In FIG. 1, a vertically-upstanding cooling tower is designated generally by the reference numeral 10. The tower 10 includes a generally cylindrical, elongated, vertically-upstanding hollow shell 12 supported by support members 13, for example, on the roof of a building.

As will be seen, the tower 10 defines a heat exchange zone 14 and a receiver zone 16 at the bottom thereof. A plurality of downwardly-facing nozzles 17 and a plurality of upwardly-facing nozzles 18 are individually connected to a common manifold 20 by way of conduits 21 which include a shutoff valve 22 for each conduit. A cold water source designated generally by the reference numeral 24, provides a source of relatively cool water to the manifold 20 and to each of the nozzles 17 and 18 respectively. The water supplied is relatively cool compared to the temperature of the relatively hot gases to be contacted. A flow gauge 26 is provided in the conduit 20 for monitoring the flow and/or temperature of the inlet water.

As illustrated, the structure of FIG. 1 is substantially identical to known structures for scrubbing and cooling gases. A hot saturated gas is provided to an inlet 28 to pass upwardly through the tower to be exhausted from a cooled gas outlet 30. The hot saturated inlet gas is substantially saturated with vapor and is relatively hot compared to the temperature and degree of saturation of the relatively cool gas exhausted from the outlet 30. Temperature gauges 29 and 30 are provided for monitoring the temperature of the gas passing through the inlet and outlet respectively. The inlet gas, as will be seen, is relatively free from particulate matter and from odiferants because of the sources of inlet gas with which the tower is preferably used. Thus, the structure of FIG. 1 does not utilize a scrubbing and particulate removal function.

The nozzles 17 and 18 direct the passage of the relatively cold water from the source 24 respectively downwardly and upwardly within the heat exchange zone 14 of the tower 10 to directly contact the saturated gas within the heat exchange zone of the heat exchanger with the relatively cooler spray of liquid. Preferably, the egress of cold water from the nozzles 17 and 18 is sufficient to substantially entirely envelop the volume of the heat exchange zone so that the dispersed relatively cold water provides a plurality of liquid phase droplets from a plurality of spray heads within the heat exchanger to form a repetitive plurality of liquid phase barriers for an intimate heat exchange contact with the substantially saturated vapor within the heat exchange zone.

As the gaseous substance is introduced through the inlet duct 28, the hot gas rises through the chamber 12 and contacts the atomized dispersed liquid in the heat exchange zone 14 and transfers a portion of its energy to the liquid. If the hot gas is a saturated vapor, as in the preferred embodiment, the vapor will condense and fall out as a liquid to the receiver zone 16. The now heated liquid will fall to the bottom of the chamber to be collected in the receiver zone 16 to flow through a return line 34 to a point of use. A temperature gauge 35 is provided at the hot water outlet for monitoring the temperature of the outflowing liquid.

Figure 2:
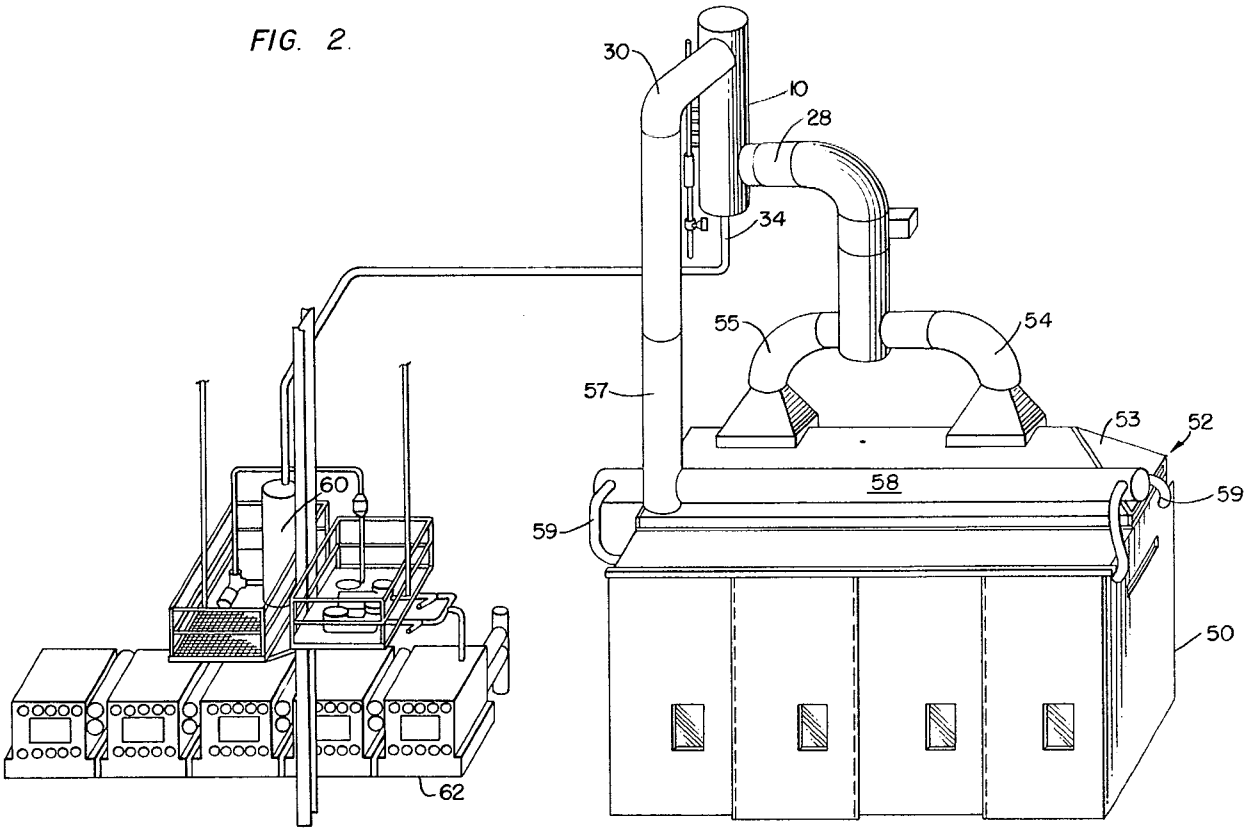
FIG. 2 is a perspective view of an overall system used in connection with a plurality of dry cans in the textile industry.

FIG. 2 illustrates a system for using the heat exchanger 10 according to the invention in connection with a dry can enclosure heat recovery system. The treating and dying of fabrics involves the use of fluids for impregnating the fabric regardless of whether the dye liquor is pumped through a stationary fabric material or the fabric material to be dyed or treated moves through the dyed or treated liquor. In continuous dying, cloth is impregnated with dye and then passes through a series of developing, washing and drying zones to a final takeup roll. In order to dry such fabrics and to fix the dyes therein, a plurality of dry cans 50 are generally provided which vaporize water from the fabric thus drying it. These cans also radiate and convect heat to the surrounding area.

In accordance with the principles of the invention, means designated by the reference numeral 52 are provided for substantially entirely enveloping a plurality of dry cans 50 and enclosing and containing substantially saturated vapors therein. The means 52 comprise a fabricated metallic or fiberglas hood 53, having a plurality of ducted outlets 54 and 55 provided to the inlet 28 of the heat exchanger 10. The hood 53 is removably sealed to the upper surface of the dry cans 50, for example, about 50 in number having a length of about 30 feet, a width of about 15 feet, and a height of about 13 feet. In this installation, the outlet gases from the outlet 30 are ducted through conduits 57, 58 and 59 to the bottom of the dry cans 50. As the cooler gas rises across the dry cans and fabric, it becomes hotter and increases in moisture content as it rises and is recycled to conduits 54, 55 and then inlet 28. Thus, by the apparatus disclosed, it is possible to reclaim and reutilize the cooled exhaust gases for heating and aiding the drying process.

This occurs substantially because the temperature and degree of saturation after passage of gas through the heat exchanger has substantially lessened.

In a typical installation, the entering air in the conduits 54 and 55 is substantially saturated with vapor from the drying process at a temperature of about 180° F. After the heat exchange in the tower 10 occurs in the manner described in connection with FIG. 1, the return air in the conduit 57 is at about 90° F. and holds less than a pound of $H_2O$ per pound of air then the substantially saturated gas entering conduit 28. Thus, the efficiency of the drying process is increased. To complete the example, the inlet water to the tower 10 is at about 70° F. while the outlet water from the tower is at about 180° F.

At the same time, the reclaimed hot condensed fluid passes from the outlet of the heat exchanger 10 through the conduit 34 to a storage tank 60, which source 60 provides a convenient source of hot water for a plurality of process installations designated generally by the reference numeral 62 within the building. Thus, the system of FIG. 2 effectively utilizes both the hot exhaust gas from the dry cans and the heated reclaimed water to recover a substantial portion of the heat which heretofore has otherwise been lost either through exhaustion of hot gases into the atmosphere or by radiation, convection and discharge of the hot gases into the building housing the dry cans. By such techniques, the convection and radiation is reduced and the degree of saturation within the environment, while more comfortable for the worker, also lessens the load on central air conditioning equipment for the building housing the dry cans.

Figure 3:
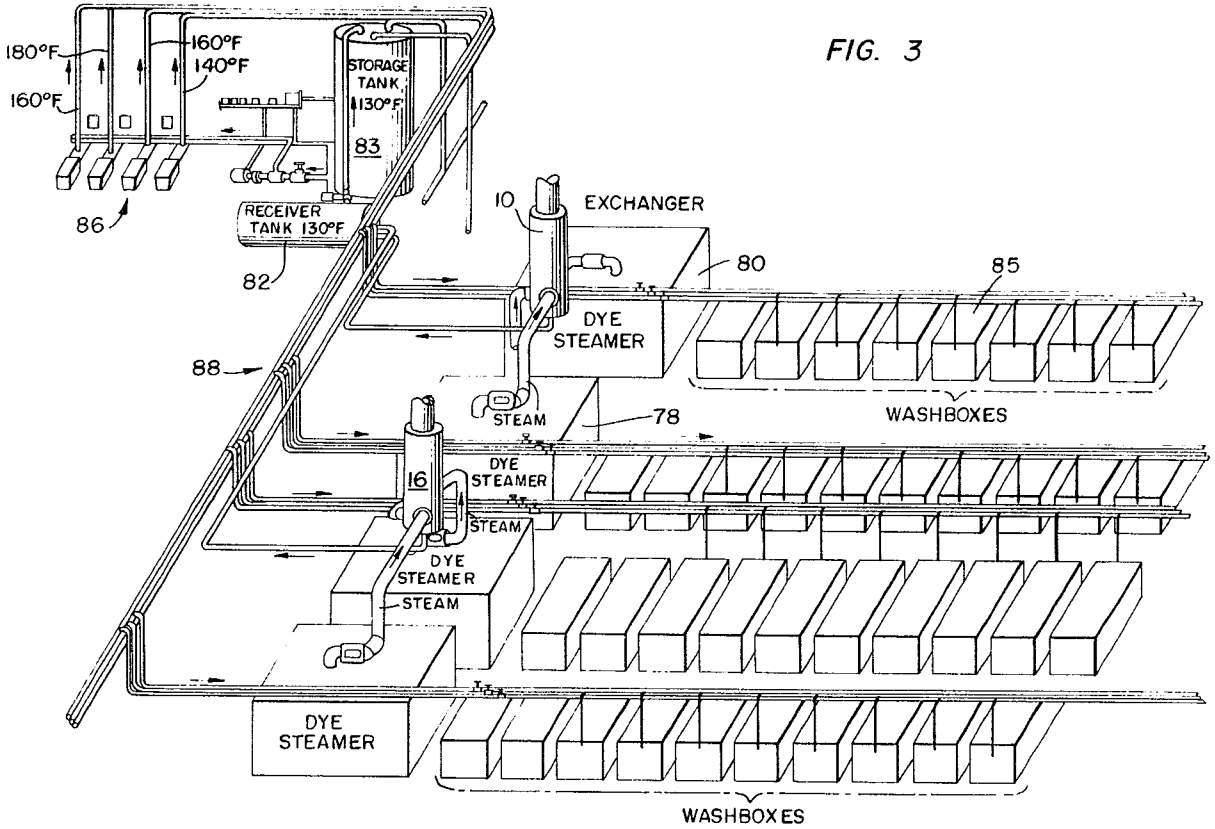
FIG. 3 is a diagram of the invention using a steamer exhaust from dye steamers for use in connection with wash boxes in the textile system and recovery of heat therefrom.

FIG. 3 illustrates another example of the use of the tower 10 in connection with the teachings of the invention and a dye steamer system using a steam source 78. Such a system for dying typically employs a steamer used for a tow or a loose web of fibers and employs the principle of coacervation to effect rapid dye fixation. The steam (saturated vapors) from the outlets of a plurality of dye steamers 80 is provided to the inlets of a plurality of heat exchangers 10, as described in connection with FIG. 1, to recover heat therefrom to provide a source of heated water to a receiver tank 82 and storage in a storage tank 83. The hot water from a hot water source, designated generally by the reference numeral 86, is thus provided to produce a source of water at varying temperatures through a conduit system 88 to a plurality of wash boxes 85 for rinsing and setting the dyed fabric. Thus, a system is described which utilizes the steam exhaust from a textile industry to provide a source of hot water to minimize the demand on hot water heaters to provide water of the necessary temperature to a plurality of wash boxes.

As can be seen, the discharge water of the heat exchanger 10 is at a temperature of about 130° F. at the receiver tank 82 and the storage tank 83. Even when additional heating of the water is required, as in FIG. 3 to provide water at temperatures of 180° F., 160° F. and 140° F. for the varying wash boxes, substantial advantages occur. The foremost advantage is that the degree of heating necessary to provide the outlet temperature is lessened.

Figure 4:
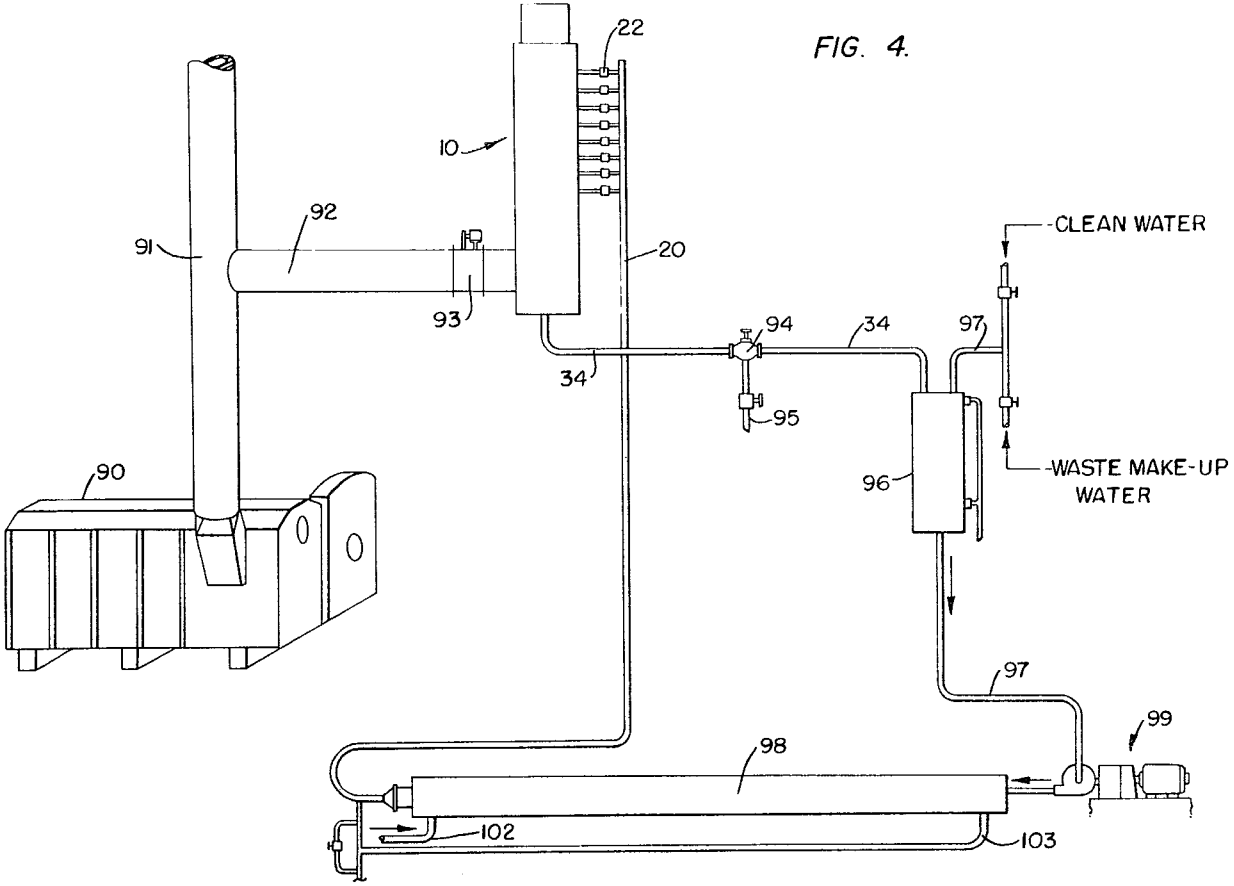
FIG. 4 is a diagram of the invention using a hot gas from a boiler exhaust.

FIG. 4 depicts still another example of the use of the tower 10 in connection with the teachings of the invention in a boiler exhaust system. A boiler 90 provides hot boiler exhaust gases in the boiler gas exhaust outlet stack 91, a selected volumetric portion of which is diverted through the conduit 92 by a supply fan 93. In this system, the operation of the direct contact heat exchanger 10 is as described in connection with FIG. 1.

The heated liquid from the receiver zone of the exchanger 10 is provided in the conduit 34 to an in-line strainer 94 having a drain 95 for filter residue. The heated liquid is provided to the receiver tank 96 where it is combined with clean water or make-up water, as needed, through a second inlet conduit 97 to the receiver tank 96.

The hot filtered contaminated liquid is provided by a conduit 97 to a shell and tube heat exchanger 98 by a recirculation pump 99. A cold clean liquid is provided to the heat exchanger 98 by conduit 102 and extracted as a hot clean liquid through the conduit 103. The cooled contaminated liquid from the heat exchanger 98 is provided on conduit 20 to the direct contact heat exchanger 10. Thus, a recirculating closed system is described.

In the system of FIG. 4, the contaminated liquid is passed through the tube side of the shell and tube heat exchanger 98 in order to transfer the heat into the clean water which is passed through the shell side of the shell and tube heat exchanger. Preferably, the recirculation of the liquid continues until such time as the contamination of the liquid reaches a level at which it adversely affects the efficient operation of the sprays in the exchanger 10 or the heat transfer rate of the shell and tube heat exchanger 98. When such level occurs, the liquid is systematically drained from the system and replaced with make-up liquid, for example, to the receiver tank 96.

Normally, the make-up liquid is non-contaminated water, normally clean process water, or potable water. However, waste water with a pH value of between 0.7 and 14.0 may also be used. Such a range is helpful in neutralizing sulfur acids produced in the process by the contact between water and the boiler exhaust gases. When the boiler 90 discharge includes carbon ash, the carbon ash aids in the absorption of color from the waste water.

In addition to the exhaust gas from a boiler, the source of hot gases may be derived from the exhaust stack of an incinerator, a curing oven, or a tinter frame, such as those used in the textile industry.

The present invention may be embodied in other specific forms without departing from its spirit or essential characteristics. The present embodiment is, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. In a process which includes the steps of:

providing a plurality of dry cans in a drying process from which vapor-saturated gas at a first elevated temperature emanates, the improvement comprising the procedural combination of steps of:

containing said emanating vapor-saturated gas and directing said gas to an upstanding heat exchanger comprising a means for receiving said contained gas;

directly contacting said vapor saturated gas in a heat exchange zone within said heat exchanger with a relatively cooler spray of liquid, said contacting step occurring as the result of a plurality of spray heads located along a substantial length of said heat exchange zone for dispersing significant amounts of said relatively cooler liquid substantially throughout the direct contact heat exchange zone in said heat exchanger, the dispersing step providing a plurality of liquid phase droplets from a plurality of spray heads in said heat exchange zone to form a repetitive plurality of liquid phase barriers for intimate contact with said substantially saturated vapor within said heat exchange zone;

collecting relatively warm liquid resulting both from the agglomeration of sprayed relatively cool liquid and condensing of at least a portion of the saturated vapor to a receiver zone of said heat exchanger;

exhausting a gas from the heat exchanger which is relatively cool compared to the substantially saturated inlet gas; and returning the gas exhausted from the heat exchanger to said dry cans as a supplemental source of make-up gas.

2. The process as set forth in claim 1 wherein the step of containing further includes the step of substantially entirely enclosing the dry cans with a hood and side panels which includes ducts connected to the hot gas inlet of said heat exchanger for conducting hot gases thereto.

3. The process as set forth in claim 1 wherein the step of collecting relatively warm liquid includes the step of using said liquid in a process remote from said dry cans.

4. In a process which includes the steps of:

providing a plurality of dry cans in a drying process from which vapor-saturated air emanates, the improvement comprising the procedural combination of steps of:

containing said emanating vapor-saturated air and directing said air to an upstanding heat exchanger comprising a means for receiving said contained air;

directly contacting said vapor saturated air in a heat exchange zone within said heat exchanger with a relatively cooler spray of liquid, said contacting step occurring as the result of a plurality of spray heads located along a substantial length of said heat exchange zone for dispersing significant amounts of said relatively cooler liquid substantially throughout the direct contact heat exchange zone in said heat exchanger, the dispersing step providing a plurality of liquid phase droplets from a plurality of spray heads in said heat exchange zone to form a repetitive plurality of liquid phase barriers for intimate contact with said substantially saturated vapor within said heat exchange zone;

collecting relatively warm liquid resulting both from the agglomeration of sprayed relatively cool liquid and condensing of at least a portion of the saturated vapor to a receiver zone of said heat exchanger;

exhausting air from the heat exchanger which is relatively cool compared to the substantially saturated inlet air; and conveying said exhausted air to a room as a supplemental source of room heating.

5. The process as set forth in claim 4 wherein the step of containing further includes the steps of substantially entirely enclosing the dry cans with a hood and side panels which includes ducts connected to the hot air inlet of said heat exchanger for conducting hot air thereto.

6. The process as set forth in claim 4 wherein the step of collecting relatively warm liquid includes the step of using the liquid in a process remote from the dry cans.

7. In a process which includes the steps of:

steam-dying fabrics in a dye steamer and, as a result, producing vapor-saturated gas at an elevated temperature, the improvement comprising:

containing said vapor-saturated gas and directing said gas to an upstanding heat exchanger comprising a means for receiving said contained gas;

directly contacting said vapor saturated gas in a heat exchange zone within said heat exchanger with a relatively cooler spray of liquid, said contacting step occurring as the result of a plurality of spray heads located along a substantial length of said heat exchange zone for dispersing significant amounts of said relatively cooler liquid substantially throughout the direct contact heat exchange zone in said heat exchanger, the dispersing step providing a plurality of liquid phase droplets from a plurality of spray heads in said heat exchange zone to form a repetitive plurality of liquid phase barriers for intimate contact with said substantially saturated vapor within said heat exchange zone;

collecting relatively warm liquid resulting both from the agglomeration of sprayed relatively cool liquid and condensing of at least a portion of the saturated vapor to a receiver zone of said heat exchanger;

exhausting a gas from the heat exchanger which is relatively cool compared to the substantially saturated inlet gas; and recovering heat from said relatively warm liquid by using said liquid in an associated process.

8. The process as set forth in claim 1, 4 or 7, further including the steps of variably heating the relatively warm liquid from said heat exchanger to varying temperatures and providing the variable temperature liquid to determined ones of a plurality of wash boxes.

* * * * *